United States Patent [19]

Scholl

[11] Patent Number: 4,503,789

[45] Date of Patent: Mar. 12, 1985

[54] AUTOMATIC SEWING MACHINES

[75] Inventor: Hans Scholl, Oerlinghausen-Lipperreihe, Fed. Rep. of Germany

[73] Assignee: Kochs Adler AG, Bielefeld, Fed. Rep. of Germany

[21] Appl. No.: 486,744

[22] Filed: Apr. 20, 1983

[51] Int. Cl.[3] ..... D05B 21/00

[52] U.S. Cl. ..... 112/121.14; 112/300

[58] Field of Search ..... 112/121.14, 121.12, 112/121.15, 102, 103, 121.11, 300, 148

[56] References Cited

U.S. PATENT DOCUMENTS 3,428,005 2/1969 Scholl ..... 112/121.15
3,701,329 10/1972 Olney, Jr. ..... 112/300 X
3,878,801 4/1975 Conner, Jr. .
4,312,283 1/1982 Fischer et al. .

OTHER PUBLICATIONS

International Shoe Machine Corporation, "Electronic Controlled Stitcher" specification article.

*Primary Examiner*—Peter Nerbun
*Attorney, Agent, or Firm*—Laff, Whitesel, Conte & Saret

[57] ABSTRACT

A computer-controlled automatic sewing machine has a sewing head and a workpiece holder. In order to be able to alternately sew at least two workpieces, the sewing head is movable in X and Y-directions by means of servomotors, while the workpiece holder having at least two workpiece clamps is fixed.

4 Claims, 6 Drawing Figures

Fig. 1
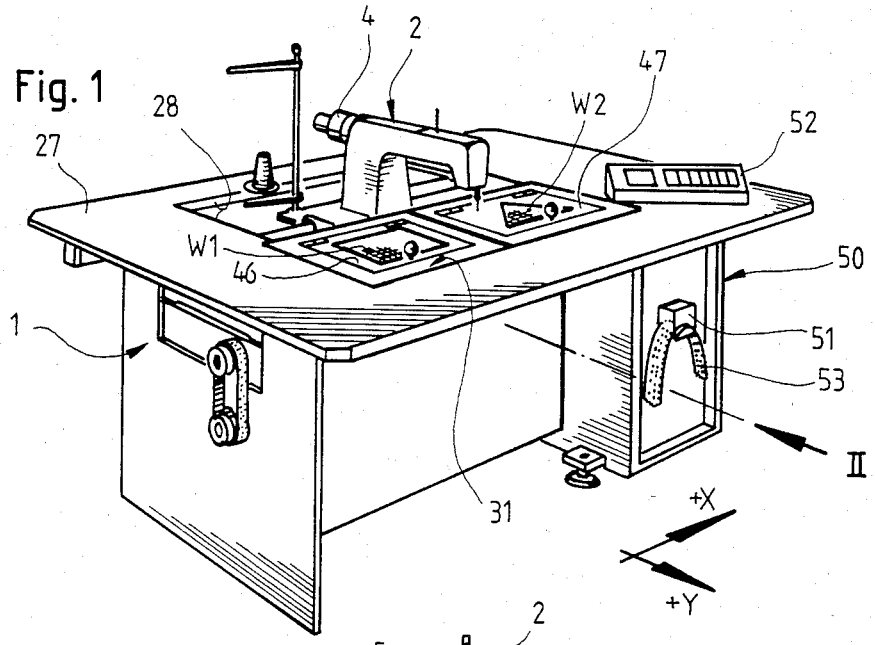
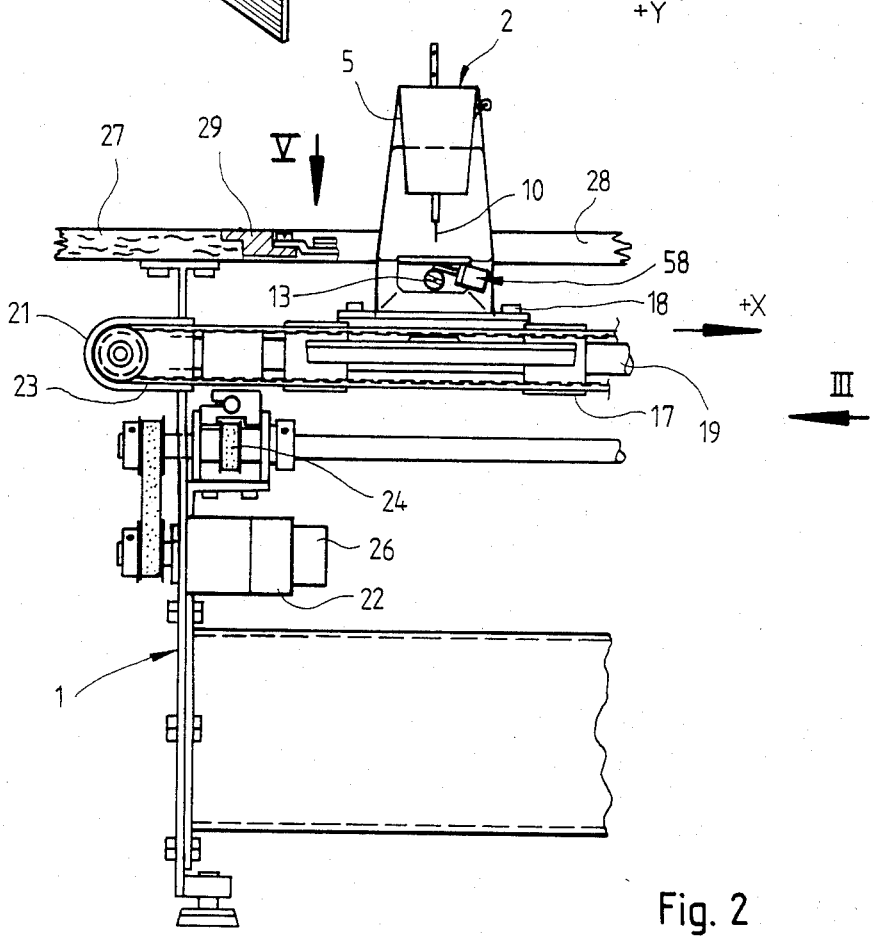
Fig. 2

AUTOMATIC SEWING MACHINES

BACKGROUND OF THE INVENTION

This invention relates to an automatic sewing machine controlled by a computer for producing a path curve or trajectory as a relative movement between a sewing head with a needle and workpieces to be sewn.

An automatic sewing machine is known from U.S. Pat. No. 4,312,283 in which the sewing head can be moved in the X-direction and the Y-direction by means of computer-controlled servomotors. A workpiece to be sewn is held in a workpiece holder, the computer being programmed in such a way that sewing takes place along the trajectory in accordance with a previously fed-in program. When the sewing process is at an end, the sewn workpiece is removed from the workpiece holder, after which a new workpiece is inserted and the sewing process is repeated.

The technical information sheet entitled "Electronic Controlled Stitcher" of the International Shoe Machine Corporation, Nashua, New Hampshire, U.S.A., discloses an electronically controlled automatic sewing machine, in which the sewing head is fixed. Two displaceable workpiece clamps are provided, which are moved in alternating manner beneath the sewing head, where a seam with a predetermined course is produced in accordance with a previously fed-in program. During this time, the workpiece can be removed from the other workpiece clamp and a new blank can be inserted. When the two workpiece clamps are firmly joined together, i.e. when the workpiece clamp to be charged is also moved with the workpiece clamp located below the sewing head, this construction is largely unusable, because it is virtually impossible accurately to introduce a blank. If, however, the workpiece clamp to be charged is disengaged from the workpiece clamp beneath the sewing head, then considerable constructional effort and expenditure are required for this.

In addition, the often very abrupt reciprocating movements of the workpiece clamps with the workpiece, so-called "shaking", are disadvantageous for the precision of the sewing process and particularly if a seam is to be made in the inner area of the workpiece surface. The reason is that the workpieces are made from flexible material and in the case of such shaking movements, displacements of the workpiece can easily take place.

U.S. Pat. No. 3,878,801 discloses a program-controlled automatic sewing machine, whose sewing head is fixed. A charging station is provided, into which blanks are inserted in spaced manner from the sewing head and these are subsequently transferred into a working station, which guides the workpiece under the sewing head, in accordance with the predetermined trajectory, accompanied by the production of a seam. Even at the time of transferring the workpieces, displacements occur. In addition, only a central clamping of the particular workpiece is possible so that further displacements are possible.

SUMMARY OF THE INVENTION

A primary object of the invention is to provide an automatic sewing machine in which, during the sewing of a workpiece, another workpiece can be inserted or removed in a simple manner.

Another object of the invention is to construct an automatic sewing machine in such a way that displacements of the workpiece are largely prevented.

In accordance with the invention, the workpiece clamps are fixed whereas the sewing head is moved in the X and Y-directions in computer-controlled manner. The seams to be successively produced on the individual workpieces in the workpiece clamps are treated as a single seam, which is broken off at the end of the seam to be sewn on the first workpiece. In addition, there is a displacement process with a non-sewing needle from the end of the seam on the first workpiece to the beginning of the seam on the second workpiece. Thus, it is possible in a very simple manner to sew different workpieces with different seam courses in the two adjacent workpiece clamps, there being no displacement of the workpieces during sewing. In a particularly simple manner, the operator can insert the workpiece blanks into the stationary workpiece clamps.

It is also particularly advantageous that the workpiece can be secured in an all-round manner in the immediate vicinity of the seam and can therefore be particularly firmly held.

Othe problems, advantages and features of the invention can be gathered from the following detailed description of a preferred embodiment, with reference to the drawings.

BRIEF DESCRIPTION OF THE DRAWINGS

FIG. 1 is a perspective view of one embodiment of an automatic sewing machine according to the invention;

FIG. 2 is a front view of part of the automatic sewing machine taken in the direction of the arrow II in FIG. 1;

DESCRIPTION OF PREFERRED EMBODIMENT

Figure 3:
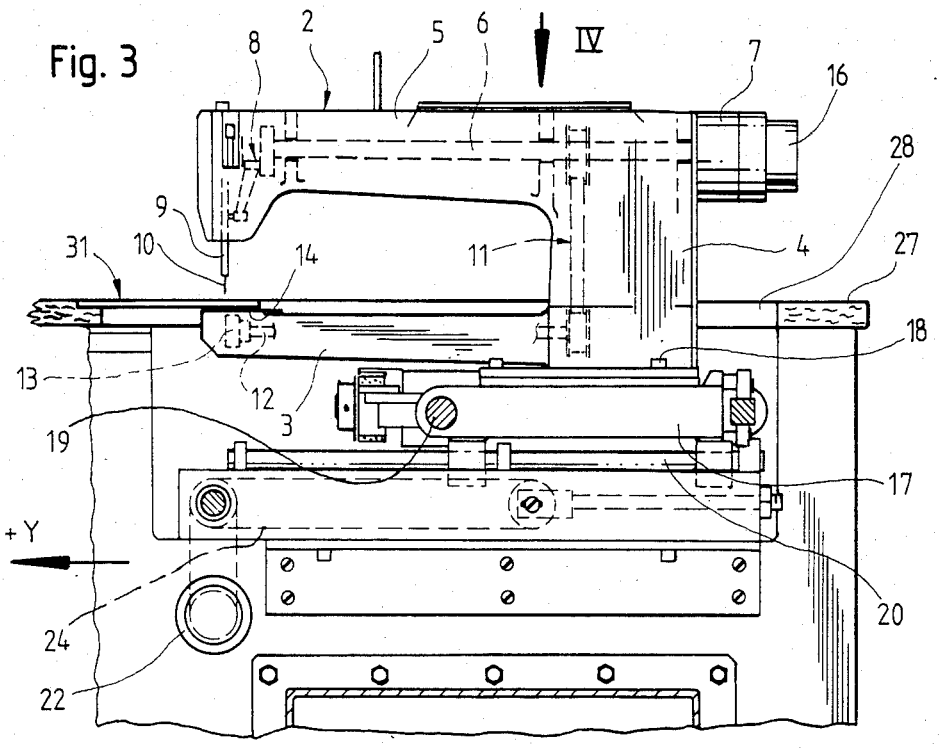
FIG. 3 is a side view of another part of the automatic sewing machine taken in the direction of the arrow III in FIG. 2.
Figure 4:
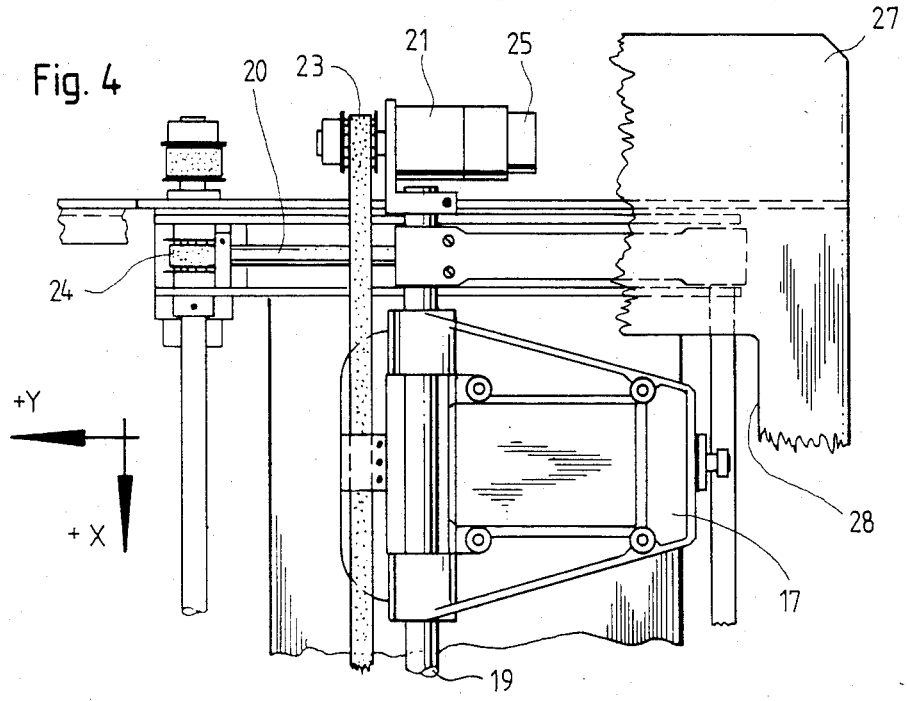
FIG. 4 is a plan view of another part of the automatic sewing machine, with the sewing head removed, taken in the directrion of the arrow IV in FIG. 3.
Figure 5:
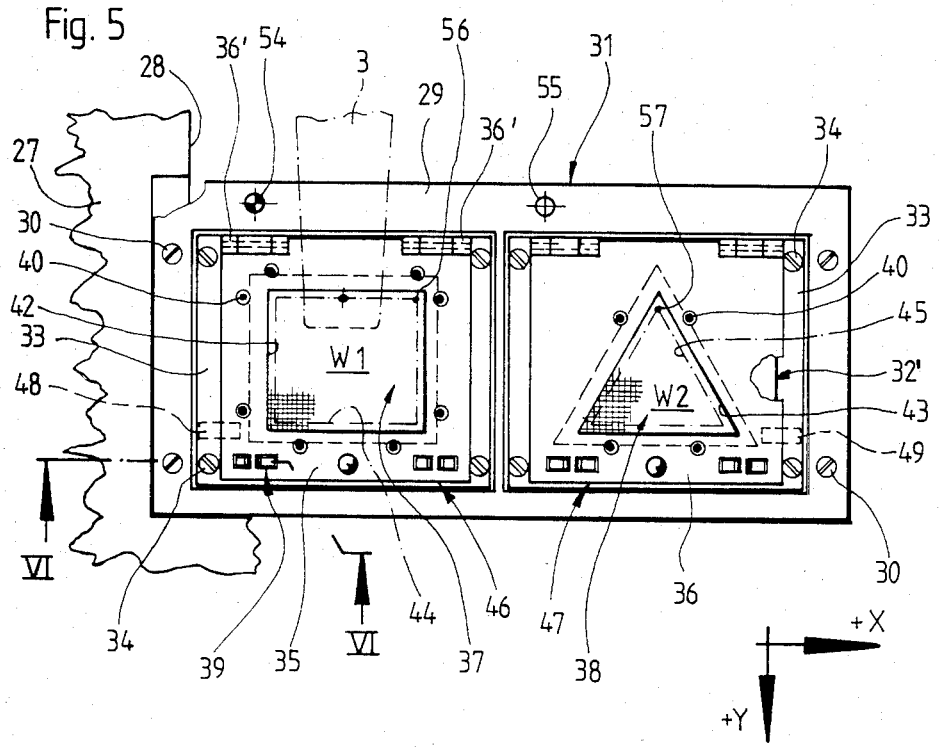
FIG. 5 is a plan view of a workpiece holder forming part of the automatic sewing machine.
Figure 6:
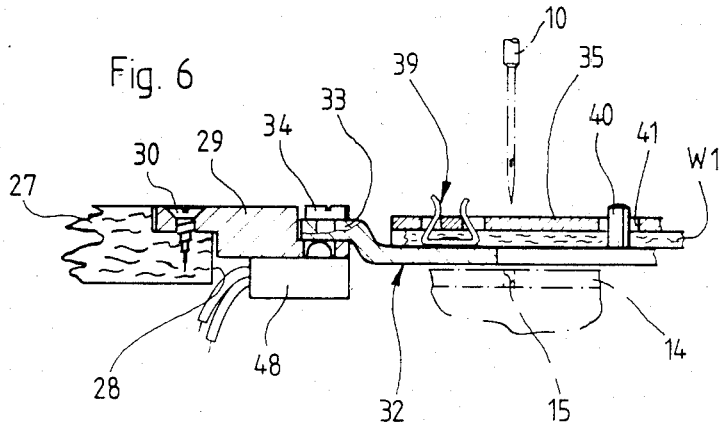
FIG. 6 is a section through part of the workpiece holder taken on the section line VI–VI in FIG. 5.

Referring to the drawings, the automatic sewing machine comprises a frame 1 on which is arranged a sewing head 2, which is formed by a base plate 3, a standard 4 projecting perpendicularly therefrom and an arm 5 extending horizontally therefrom and approximately parallel to the base plate 3. In the arm 5 is mounted an arm shaft 6, which can be driven by an externally flanged positioning drive 7. The arm shaft 6 is provided with a crank drive 8 enabling a reciprocating movement to be imparted to a needle bar 9. A needle 10 is fitted to the lower end of the needle bar 9. A hook shaft 12 located in the base plate 3 is driven by the arm shaft 6 via a timing belt drive 11. At the end of the shaft 12 associated with the needle 10, a double lock stitch hook 13 is provided which is positioned below a throat plate 14 fitted to the base plate 3 and having a stitch hole 15 in the path of the needle 10. An encoder 16 is fitted to the positioning drive 7 which, during each needle stroke, emits a zero pulse, from which it is possible to derive information on the position of the needle 10 at this time.

The sewing head 2 is fixed by means of screws 18 to a carriage 17 which, on two perpendicularly arranged horizontal guide bars 19, 20 is movable in the X-direction (guide bar 19) and Y-direction (guide bar 20). The sewing head 2 is moved in the X and Y-directions on guide bars 19 or 20 by means of servometers 21, 22 via timing belt drives 23, 24. The servometers 21, 22 are provided with encoders 25, 26, which determine the position of the needle 10 in the X and Y-directions.

A plate 27 is arranged on the frame 1, which plate has a cutout 28, through which the sewing head 2 projects upwards and within which the sewing head 2 is movable in the represented manner in the X and Y-directions.

A supporting frame 29 is fixed by means of screws 30 in the cutout 28 on the associated edge of the plate 27. A workpiece holder 31 is fixed to the supporting frame 29. The workpiece holder has two lower plates 32,32', whose upwardly bent margins 33 are fixed by means of screws 34 to the supporting frame 29. By means of hinges 36' two juxtaposed upper plates 35, 36 are hinged in upwardly swingable manner in the X-direction to the lower plates 32, 32'. Each upper plate 35, 36 has a cutout 37, 38 corresponding roughly to the seam course to be produced. The upper plates 35, 36 can be elastically locked to the lower plates 32, 32' in a clamping position securing a workpiece W1 or W2 to be sewn, by means of lock elements 39.

In addition, the lower plates 32, 32' carry upwardly projecting positioning pins 40, which project with a clearance into the particular upper plate 35 or 36. The positioning pins 40 are arranged in accordance with the periphery of the workpiece W1 or W2 to be received and serve to position the same.

The lower plates 32, 32' have cutouts which coincide with the cutouts 37, 38 in the associated upper plates 35, 36 and the limiting edges 42, 43 of said cutouts are positioned directly alongside the particular seam 44 or 45 to be produced. As a result of the aforementioned construction, two workpiece clamps 46, 47 are formed. The supporting frame 29 also carries two switches 48, 49, which are operated when the clamps 46, 47 are installed. The lower surfaces of the lower plates 32, 32' are located on or immediately above the upper surface of the throat plate 14.

A computer 50 with an input device 51 is provided for controlling the automatic sewing machine. The computer functions are manually started by means of a panel 52. Before the start of a sewing process, a data carrier 53, e.g. a perforated strip or EPROM is placed in the input device 51 and the information contained thereon is read into the computer 50, as soon as the instruction to do this is given by the panel 52.

Apart from identifying coding for a workpiece holder 31 or workpiece clamps 46, 47, the data carrier 53 contains support points for the course of seams 44, 45 to be controlled. These support points are given as X and Y-coordinates of the seams 44, 45 to be formed. They constitute computer variables for the computer algorithm, with which the remaining points of the seam can be calculated by linear or circular interpolation. In addition, special points of the seams are fed in, such as e.g. corner points, so that the computer program on reaching such support points can carry out special program branches to take account of the complicated control configuration in the vicinity thereof. In addition, the data carrier 53 supplies the computer 50 with information about the particular parts of the sewing curve where additional variables have to be taken into account. The seam pattern is produced in such a way that the servomotors 21, 22 are controlled by the computer, in accordance with the course of the seams, 44, 45. In each case, the encoder 16 supplies the computer 50 with a signal concerning the position of the needle. In addition, the positioning drive 7 is controlled by the computer 50, so that even in the case of complicated seam courses with discontinuities, the needle only stitches in points of the desired path and not in those which can result from overswings of the sewing head 2 moved in the X and Y-directions at such critical points of the seam course.

The sewing program on the data carrier 53 also ensures that the sewing head 2, starting from a frame-bound stationary reference point 54, which can be the absolute system reference point, assumes a program zero point 55. The points 54 and 55 are in each case associated with the needle 10 and the point 54 can be formed by corresponding sensors on the frame 1.

Firstly, workpieces W1 or W2 are inserted in the workpiece clamps 46, 47. The upper plates 35, 36 are now folded down and by means of the lock elements 39 are clamped to the lower plates 32, 32'. The workpieces W1 and W2 are now clamped in the correct position for the sewing process.

After operating a starting button on the panel 52, the sewing head 2 is moved in such a way that from the program zero point 55, the needle 10 moves in non-sewing manner to a seam starting point 56 of a seam 44 to be made on workpiece W1. The sewing head 2 then produces the, in this embodiment approximately square, seam 44, which is again terminated at point 56 by a thread cutting process.

Following this, the sewing head 2 is moved in such a way that the needle 10 is moved from the point 56 to a seam starting point 57 of the seam 45 to be sewn on the workpiece W2. The sewing head 2 then produces the, in this case triangular, seam 45 and again terminates this with a thread cutting process. During the production of the seam 45 on the workpiece W2, and operator can remove the previously sewn workpiece W1 and place in the workpiece clamp 46 a new workpiece to be sewn and again close said clamp. During the sewing of the seam 44 on the workpiece W1, it is possible to perform the corresponding operations on the workpiece clamp 47 for the other workpiece W2. At the end of the sewing of the seam 45 on the workpiece W2, the sewing head 2 is again moved back to the seam starting point 56, from where a new sewing cycle can commence.

If the seams 44 and 45 to be produced on workpieces W1 and W2 differ considerably from one another and consequently lead to widely varying cycle times, it may be necessary for the sewing head 2 to stop after ending a seam 44 or 45, during which the needle 10 remains at the program zero point 55 until a new starting instruction is received.

If only one workpiece clamp 46 or 47 is fixed in the supporting frame 29, the sewing head 2 is only moved backwards and forwards on a path from the program starting point 55 to the seam starting point 56 or 57 for the purpose of inserting or removing workpieces.

The aforementioned thread cutting processes are carried out by means of a thread cutting device 58 arranged in conventional manner alongside the stitch hole 15 below the throat plate 14, i.e. associated with the hook 13, said device also being controlled by the computer 50.

The invention is not restricted to the abovedescribed embodiment but modifications and variations may be made without departing from the scope of the invention as defined by the appended claims.

What is claimed is:

1. An automatic sewing machine having a computer for producing a trajectory as a relative movement between a sewing head with a needle and workpieces to be sewn in a plane substantially perpendicular to the direction of movement of the needle, computer-controlled servomotors for moving the sewing head in two perpendicularly directed coordinate directions for producing the said relative movement, a fixed workpiece holder with at least two workpiece clamps for receiving in each case one workpiece, thread cutting means, each workpiece clamp being independently operable to permit removal of a first workpiece while sewing a seam on a second workpiece, said computer being programmed in such a way that the sewing process takes place along the trajectory in accordance with a previously fed-in program, so that after sewing a seam on a first workpiece, the thread cutting means are operated, the sewing head is then moved over the second workpiece without performing a sewing process and then a further seam is sewn, which is ended by operating said thread cutting means.

2. An automatic sewing machine as claimed in claim 1, in which each workpiece clamp has a lower plate and a pivotable upper plate facing it, lock elements being provided to lock said plates together and said plates having cutouts corresponding to the seam course and whose limiting edges are located in the vicinity of the seam to be produced.

3. An automatic sewing machine as claimed in claim 2, in which said workpiece clamps are detachably fixed in a supporting frame which is fixed to the automatic sewing machine.

4. An automatic sewing machine as claimed in claim 3, in which a switch is associated with each workpiece clamp and is operated whenever the associated clamp is removed.

* * * * *